US006406550B1

(12) United States Patent
Feldbauer et al.

(10) Patent No.: US 6,406,550 B1
(45) **Date of Patent: *Jun. 18, 2002**

(54) APPARATUS AND METHOD FOR SEQUENTIAL REMOVAL OF OXIDES FROM STEEL

(75) Inventors: Stephen L. Feldbauer, Jackson Center; Brian H. Braho, Ellwood City, both of PA (US)

(73) Assignee: Danieli Technology, Inc., Cranberry Township, PA (US)

( * ) Notice: Subject to any disclaimer, the term of this patent is extended or adjusted under 35 U.S.C. 154(b) by 6 days.

This patent is subject to a terminal disclaimer.

(21) Appl. No.: 09/584,931

(22) Filed: Jun. 1, 2000

Related U.S. Application Data

(63) Continuation-in-part of application No. 09/144,003, filed on Aug. 31, 1998, now Pat. No. 6,217,666.

(51) Int. Cl.[7] ..... C23G 5/00; B08B 1/02

(52) U.S. Cl. ..... 134/2; 134/15; 134/17; 134/30; 134/37

(58) Field of Search ..... 134/2, 15, 17, 134/30, 37; 216/58, 76; 156/345 V

(56) References Cited

U.S. PATENT DOCUMENTS 2,625,495 A * 1/1953 Cone et al. ..... 134/15
4,259,002 A * 3/1981 Thawley et al. ..... 134/72
6,217,666 B1 * 4/2001 Feldbauer ..... 134/2

* cited by examiner

*Primary Examiner*—Randy Gulakowski
*Assistant Examiner*—Saud Chaudhry
(74) *Attorney, Agent, or Firm*—Paul A. Beck & Associates

(57) ABSTRACT

Oxides on the surfaces of metal are reduced by directing reducing gases at them in a forceful and turbulent manner. In a preferred version, the gas is passed through at least two reducing zones designed to maintain a higher concentration of reducing gas in at least one of them than would be the case in a single reducing zone. The oxide-bearing surface is heated at the beginning of the process.

26 Claims, 6 Drawing Sheets

APPARATUS AND METHOD FOR SEQUENTIAL REMOVAL OF OXIDES FROM STEEL

RELATED APPLICATION

This is a continuation-in-part of the application of one of us, Stephen L. Feldbauer, Ser. No. 09/144,003 filed Aug. 31, 1998 now U.S. Pat. No. 6,217,666, originally entitled "Apparatus and Method for Continuous Removal of Oxides from Metal".

TECHNICAL FIELD

This invention relates to the reduction and removal of oxides from the surface of metal. The metal containing surface oxides is passed into or through an enclosure, continuously, intermittently, or batchwise, in which it is heated and contacted with reducing gas.

BACKGROUND OF THE INVENTION

Newly formed metal strip, rod, and the like tends to develop oxides on its surface which must be removed before further processing. In the steel industry, this oxide layer is called mill scale. Mill scale is almost universally removed by acid pickling. Copper and other metals also require treatment for the removal of oxide scale.

Hydrogen and other reducing gases such as carbon monoxide have been used for the reduction of oxides in ores, where they are substantially consumed within a reducing furnace or vessel. Hydrogen is readily burned and can cause explosions under certain circumstances, and carbon monoxide is poisonous and generally considered dangerous unless confined and reacted in a vessel of the type generally contemplated in ore reduction. Moreover, steel strip and many other metal products made continuously move at a rapid pace, increasing the difficulty of conducting the oxide removal process with gases within the time constraints normally imposed. Thus, while the elementary chemical principles of oxide removal and/or reduction by reducing gases are known, an acceptable continuous surface oxide reduction system employing reducing gases has not been forthcoming in the art.

SUMMARY OF THE INVENTION

Our process and apparatus provide for three stages or zones for the processing of the moving metal, which may be any metal having oxide on its surface, in any commercially common shape, such as strip or rod. The three basic stages are heating, reducing, and cooling. All three steps take place within an enclosure of the type to be described in more detail below, and under the conditions to be described in more detail below. Heating in the heating zone is accomplished by a combination of a heating element or device to be described below and post-combustion of unreacted reducing gas. Reduction of the oxide scale in the reduction zone is accomplished by assuring a turbulent and/or vigorous application of reducing gas to the surface of the metal, preferably in the presence of elemental carbon; cooling of the metal in the cooling zone prior to its exit from the enclosure is accomplished by the introduction of inert gas along with the unheated reducing gas to contact the reduced surface of the metal just prior to its exit from the enclosure. The metal surface should preferably be cooled to a temperature at which reoxidation is unlikely to occur; in the case of steel strip, this is 500° F. or lower.

DETAILED DESCRIPTION OF THE INVENTION

It is known that the oxide layer on steel strip may contain $Fe_2O_3$, $Fe_3O_4$, and/or FeO, or various ratios of the three oxide forms depending on the conditions in which the product is made and conducted to the next processing stage. $Fe_3O_4$ may pass through the $Fe_2O_3$ stage before it is further reduced to FeO and then completely reduced to iron. Where hydrogen is the reducing agent, water is produced; where carbon is the reducing agent, carbon monoxide is first produced, and where carbon monoxide is the reducing agent, carbon dioxide results. Our invention contemplates the use of either hydrogen or carbon monoxide, or any other commercially feasible reducing gas, in the absence of or together with elementary carbon as a supplementary reductant.

Further, the hydrogen may be manufactured within the enclosure or in its immediate vicinity. Examples of the manufacture of hydrogen include known processes for accomplishing the dissociation of methane, and the combustion of methane or other hydrocarbons in such a way as to produce excess hydrogen.

Figure 1:
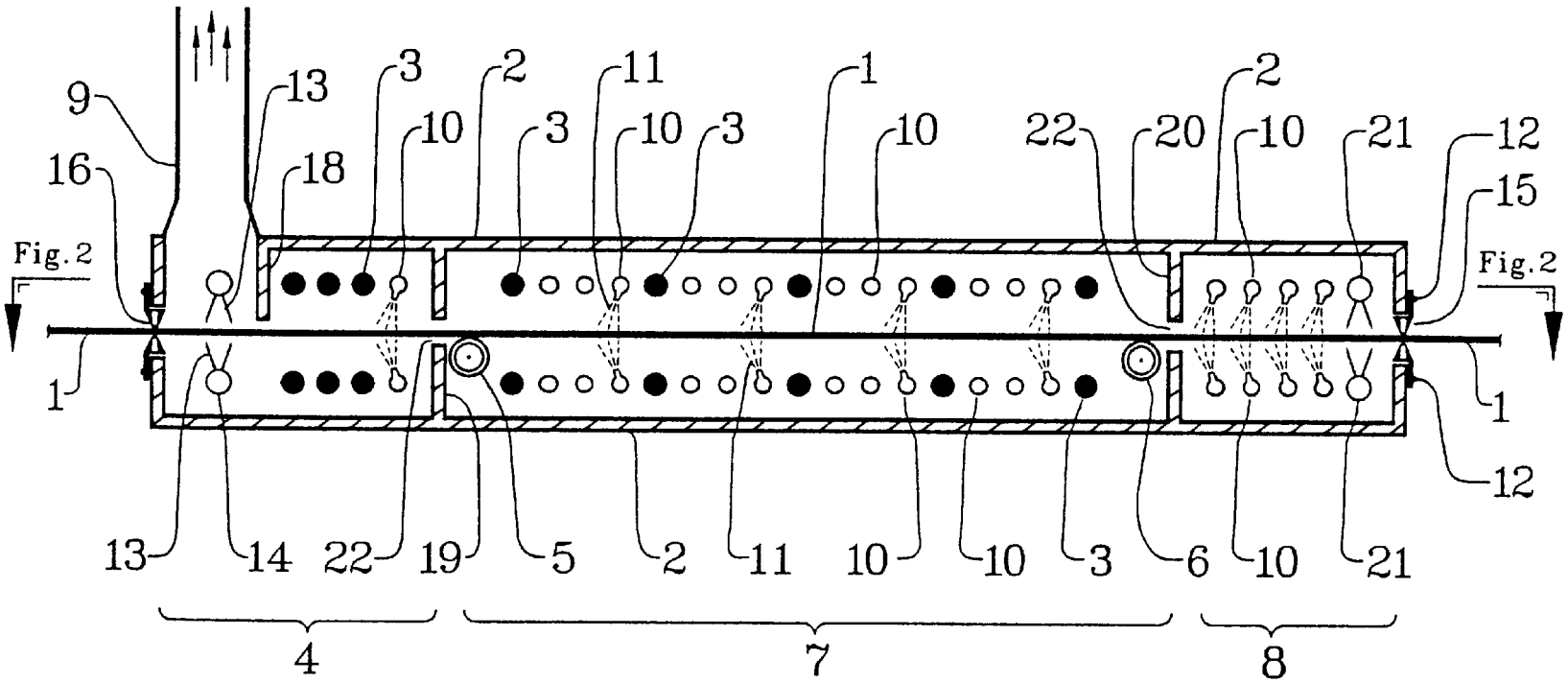
FIG. 1 is a more or less diagrammatic side sectional view of a preferred configuration of the enclosure including all three zones included in our invention, as applied to steel strip.

FIG. 1 illustrates the invention applied to steel strip 1 from which mill scale, or a layer of oxide, must be removed. Steel strip 1 is caused to pass into enclosure 2 in the direction, as depicted, from left to right. It may be held in enclosure 2 for a period of time or moving at a speed up to as fast as 2000 feet per minute. The strip 1 may be preheated before entering enclosure 2, but is heated within enclosure 2 by heating elements 3, preferably radiant heaters, to ensure that the temperature of its surfaces is at least 752° F. (400° C.) by the time it leaves the heating zone, which is designated by the numeral 4. In the case of copper and other metals, the oxide surface should be heated to at least 300° F.

At the entrance of the strip 1 to the enclosure 2 is a flame 13 and a flue 9 for conducting exhaust gases out of the system. The heating of strip 1 is assisted by the post-combustion of the unconsumed reducing gases by air optionally introduced through inlets 14 in the heating zone 4. Introduction of the air through inlets 14 will cause immediate combustion of whatever reducing gas, usually hydrogen, remains in the atmosphere moving from right to left, as depicted. Preferably the flow of air will be directed at the strip so as to ensure the most efficient use of the thermal energy generated by the combustion, that is, to heat the strip. The action of the flame 13 creates a draft continuously moving gases from right to left, as depicted—from the enclosure strip exit 15 to the strip entrance 16, thus providing a constant countercurrent contact of gas to the strip.

The strip 1, supported by rolls 5 and 6, is then passed into reducing zone 7. Rolls 5 and 6 may be replaced by any suitable support, and also may be replaced by graphite or carbon blocks of a consistency so that a thin film of elemental carbon is deposited or rubbed onto the strip surface, preferably both the top side and the under side.

Reducing gas 11, usually hydrogen, is continuously introduced through small apertures 7 (see FIG. 2) in manifolds 10, and directed, preferably at a slight angle of 5–30 degrees, in the direction of the oncoming strip 1 at a velocity to create turbulence on impact with the strip 1. Where carbon is deposited on the strip, the deposition preferably occurs in the upstream half of the reducing zone 7, so there will be time for it to react with the oxides on the surface of strip 1. This zone is called the reducing zone because a large part of the reduction of the oxides occurs in this zone, but it should be understood that some oxide may be reduced in the heating zone 4 due to the continued presence there of at least some reducing gas, and in the cooling zone 8 in part because of the continued presence of reducing gas carried into the cooling zone 8 by strip 1. In the reducing zone 7, the temperature of the surfaces of the strip is maintained at the temperature necessary for the reducing reaction to take place. In the case of steel strip, this is at least 400° C. (752° F.). In the case of copper and other metals, the surface should have a temperature of at least 300° F.

Moving on, the strip 1 passes into the cooling zone 8. In cooling zone 8, the strip 1 is caused to cool by the introduction of new reducing gases through manifolds 10. The reducing gases introduced separately through manifolds 10 may be mixed with inert gases introduced through separate inlets 21 or premixed with the reducing gases. Introduction of inert gases here will minimize the possibility of mixing air with the reducing gases. When used, inert gases may be mixed with the reducing gas in volume ratios of from 1:99.9 to 99.9:1. The strip then passes out of enclosure 2 through fabric curtain 12 and may be coiled or further processed in a hot or cold rolling mill, a slitting station, a galvanizing line, or it may be oiled, otherwise processed, or simply coiled. Brushing may be beneficial during or after cooling. In the case of steel strip, the mill scale will typically have been reduced to a sponge iron layer, perhaps still containing some oxides, but readily removable by brushing. In the case of copper and other metals, brushing will assure a clean appearance.

Figure 2:
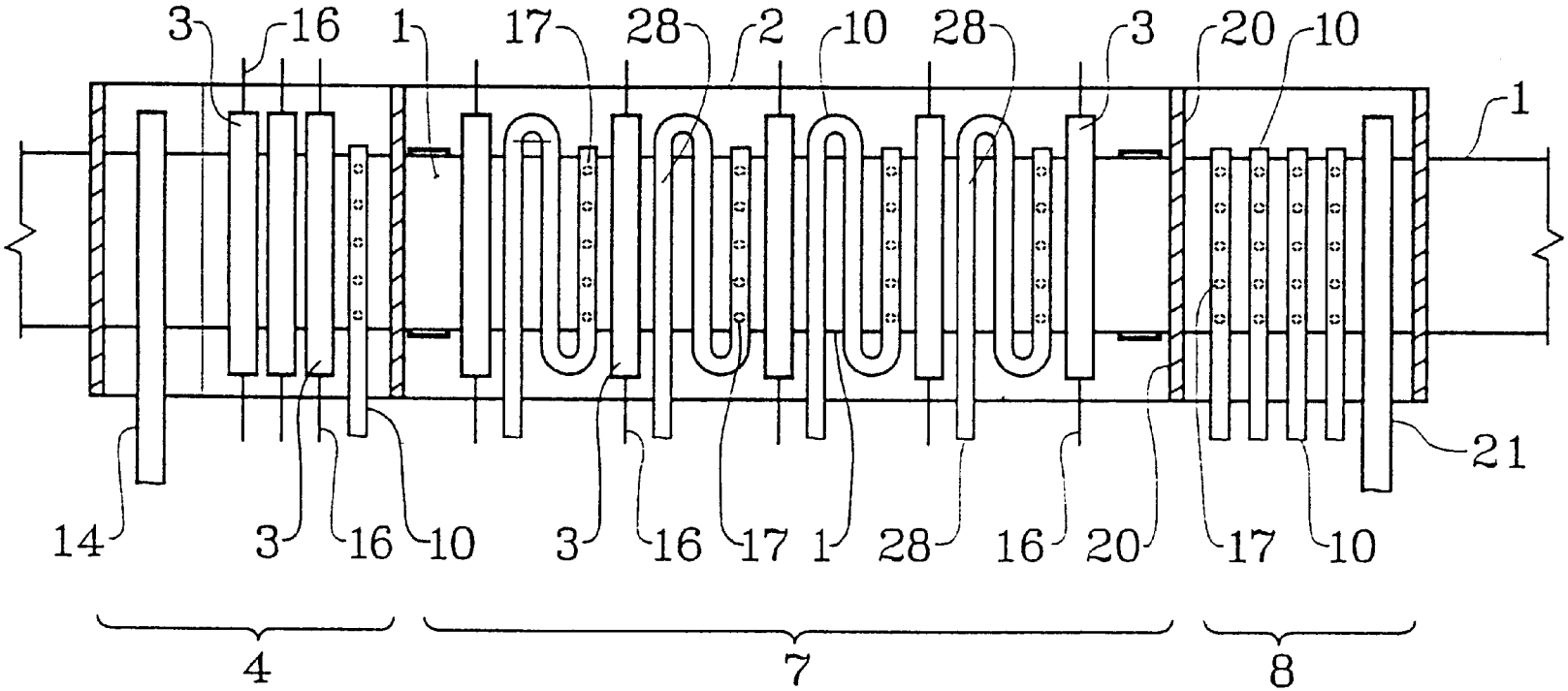
FIG. 2 is an overhead view from within the same enclosure.

FIG. 2 illustrates the parts of enclosure 2 from above heating elements 3 and manifolds 10. Strip 1 is underneath heating elements 3 and manifolds 10. Manifolds 10 are seen to have a plurality of gas apertures 17 for releasing gas. These are on the underside of the manifolds 10 and aimed so the reducing gas may be directed with force toward the strip 1, preferably in the direction from which the strip 1 is traveling. Heating elements 3 have electrical connections 16. Note that divider 18 appears only on the top side of strip 1 (see FIG. 1); dividers 19 and 20 are above and below the strip 1. Preferably the reducing gas manifolds 10 have one or two lengths 28 within enclosure 2 before releasing gas through apertures 17, so the gas can be partially preheated before being released.

Figure 3:
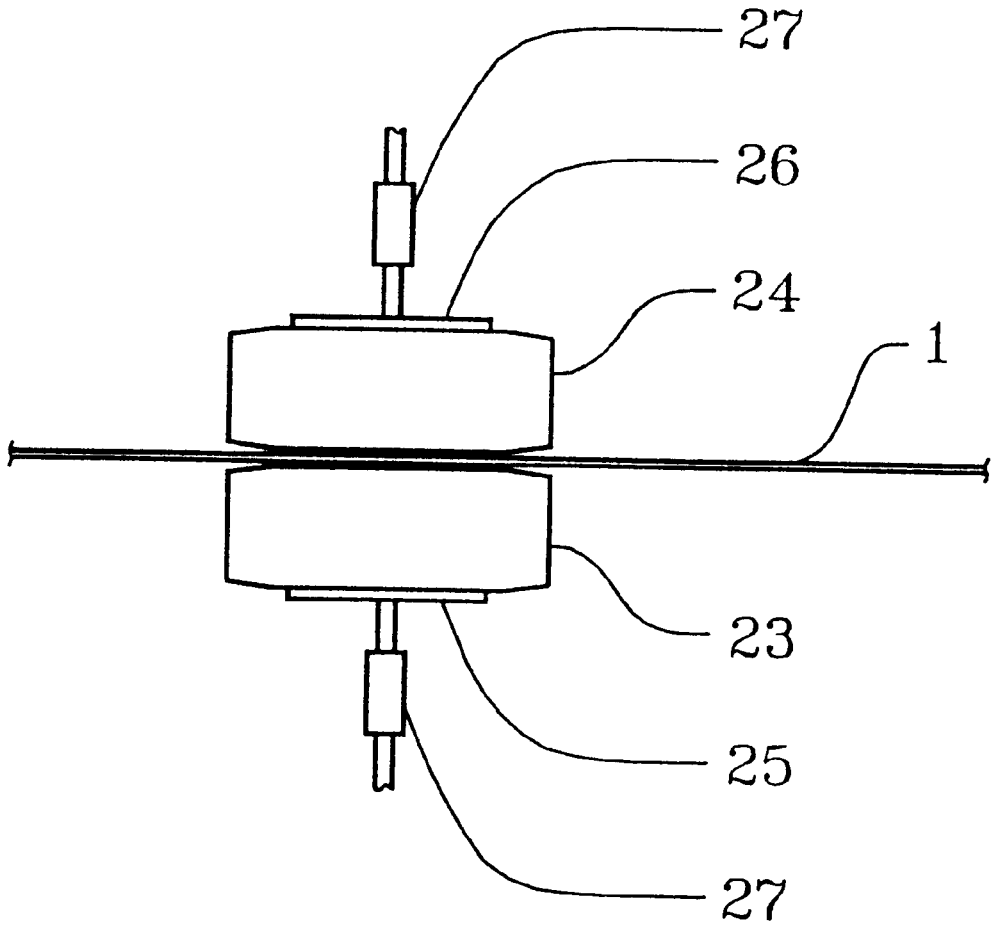
FIG. 3 shows a preferred device for distributing carbon on the strip surface.

FIG. 3 is an optional device for depositing elemental carbon on both sides of strip 1. The device includes carbon blocks 23 and 24 secured to bases 25 and 26, which in turn are connected to pneumatic cylinder 27 made to urge the carbon blocks 23 and 24 toward strip 1. The carbon blocks 23 and 24 may be made of graphite, anode pitch, or any other convenient composition substantially of carbon which will deposit a thin film of carbon on the strip as it passes between the blocks 23 and 24. Alternatively, only one block may be used; in either case the carbon blocks may to some extent replace or supplement the supporting function of rolls 5 and 6 (FIG. 1).

The following guidelines may be used for the treatment of steel strip by our invention, although it should be understood that our invention is applicable to other metals, such as copper, having oxides on their surfaces.

Typically, steel strip will have an oxide layer about 0.009 inch thick, commonly from 0.005 to 0.015 inch, and contain about 1 mole to about 1400 moles of oxygen per square meter of surface. Thus, about 1.1 moles to about 1400 moles of hydrogen, will be required for complete reduction of the oxides. The oxide layer on copper is generally from about 0.0005 to 0.025 inch. It is known that the microstructure of the scale on the surface of steel shows numerous small crevices between adherent particles of iron oxide, and a significant portion of the oxide is effectively undermined and loosened by the effect of the reducing fluid. This is true also of copper and other metals. Our invention therefore requires that the reducing gas is contacted with the oxide layer in a vigorous, turbulent manner to assure the continuous replenishment of reactants to the metal/oxide surface and continuous convection of the reaction products, i.e. especially water, away from the gas/solid interface. This vigorous, turbulent contacting to enhance the gas phase mass transfer is preferably accomplished by introducing the gas through ports directed toward the surface from which the oxide is to be removed. Because of the undermining and loosening effects mentioned above, it is not necessary for every atom of oxygen to react with a reducing gas; as a significant portion of the oxide will be sufficiently loosened and/or undermined that it can be easily removed mechanically, such as by brushing; in addition, the turbulent action of blowing the reducing gas on the surface of the strip in the strip cooling zone 8 will loosen and remove some of the oxide particles.

To further enhance the reducing reaction in the reducing zone, reducing gas may be introduced directly to the reducing zone after first being preheated. Because gas in the cooling zone is employed partly to cool the strip, the gas introduced there is not to be preheated. Preheating of gas for introduction to the reducing zone may desirably be to a temperature of 900 to 2000° F., and can be accomplished at least partially by directing the fresh reducing gas through extra lengths 28 of manifolds 10 within enclosure 2, where it will pick up heat energy from the environment. Prior to passing into such pipes within the enclosure, the gas may be partially preheated by any suitable means.

Only the surface need be heated to the desirable reduction reaction temperature. Suitable devices for heating are radiant tubes, induction coils, and gas burners. By heating of the surface, we mean the oxide layer, which may be from 0.005 inch thick to 0.01 inch thick, on steel strip, and seldom more than 0.015 inch. Thus, temperatures of 752° F. (for steel) need not extend to a depth of more than 0.017 inch and, in most cases, 0.015 inch will be sufficient. Because the oxide layer on copper is less thermodynamically stable, the heating to 300° F. need not extend below the oxide layer.

In addition to the heating methods and means mentioned above, heating of the reducing gas may be accomplished by passing it through passages in heated carbon blocks.

It will be noted that our invention contemplates a use of the reducing gases to a such degree of efficiency that no recycling is necessary. Recycling of the exhausted reducing gas stream would require removal of the chief reduction product, water, from the gas to be recycled, which is very difficult to do to the extent necessary. Likewise, it would mean cooling the recycled reducing gas, thus setting up a continuous process of heating and cooling of the reducing gas. Rather, our invention contemplates the efficient use of the reducing gas in enclosure 2 by inducing turbulence and direction of the gas onto the surface of the metal to assure continuing contact and replacement of gas and reduction products on the surface. Preferably at least 5%, more preferably at least 50%, and most preferably at least 90%, of the reducing gas introduced to the enclosure is consumed in the reduction reaction, and the reset is consumed in flame curtain 13.

Figure 4:
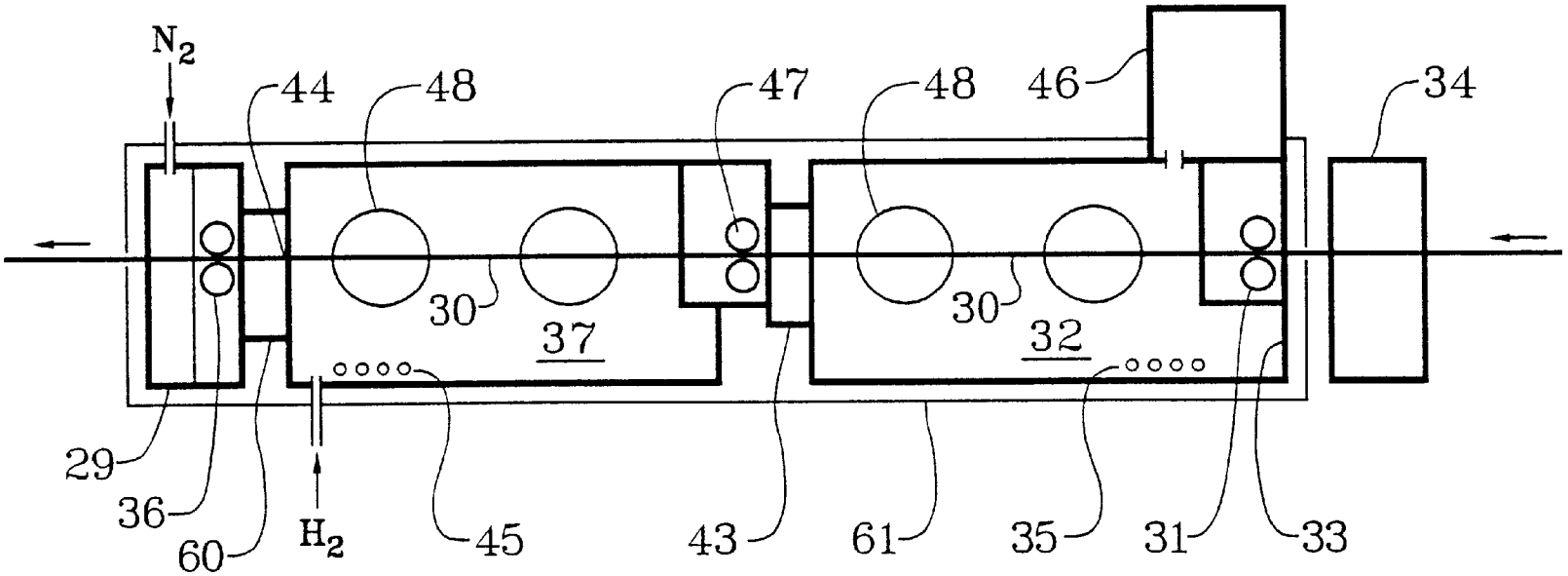
FIG. 4 is a more or less diagrammatic side view of a further preferred separate enclosure for the reducing zone.

Referring now to FIG. 4, a further preferred reducing system is illustrated. In this variation, hot rolled steel strip 30 is seen moving from right to left. The steel strip 30 emerges from a furnace 34 where it was heated to at least 400° C. (about 750° F.) Although there is no need to heat it above 750° C. (about 1380° F.), our process will accommodate temperatures up to about 2400° F. The heated strip 30 first passes through sealing rolls 31 to enter initial reducing compartment 32. The sealing rolls 31 are configured and installed to seal off the front end 33 of reducing compartment 32, to minimize the escape or leakage of hydrogen and other gases into furnace 34 or into the atmosphere. There may be an overall enclosure 61. Radiant tubes 35 may be used to further heat the strip 30 or maintain it at a desired temperature.

The reducing zone may comprise one reducing compartment but preferably comprises at least two reducing compartments 32 and 37, positioned in tandem so the strip 30 will pass directly from one to the other. The compartments 32 and 37 are each sealed enclosures except for the provisions for entrance and exit of the strip 30 and reducing gas to be explained below. Compartments 32 and 37 may have a common wall.

Reducing gas, preferably hydrogen, is introduced near the strip exit 44, in this case into the second reducing compartment 37. As illustrated, it is preferably introduced to reducing compartment 37 prior to the point where the strip 30 leaves reducing compartment 37. An inert gas, preferably nitrogen, may be introduced to provide a positive pressure in a chamber 29 also near the strip exit. Radiant heaters 45 may be employed for the strip because the hydrogen is normally not heated. The reducing gas flows generally from left to right, as depicted, countercurrently to the strip 30, through reducing compartment 37 where it continually contacts strip 30, through passage 43 to reducing compartment 32, where it again continually contacts strip 30 moving countercurrently, and proceeds to exhaust trap 46, to be explained in detail in FIG. 6. Throughout its passage from near strip exit 44 to passage 43 and further to exhaust trap 46, the gas is contacted with strip 30 and reacts with the mill scale on the strip 30, manufacturing water (where hydrogen is the reducing gas) from the combination of hydrogen and oxygen from the mill scale. As indicated above, not all of the oxygen needs necessarily to combine with hydrogen to effect removal of the mill scale, since some of the reaction will undermine the scale, weakening its adhesion to the strip 30 so it can be readily removed by physical contact such as brushing, Ideally, the reducing gas will be entirely consumed by the time it reaches the safety trap 46, but in practice as little as five percent is consumed, and provisions must be made for assuring that no hydrogen or other reducing gas escapes to the atmosphere, where it could cause a fire or explosion. These will be explained with reference to FIG. 6. Sealing rolls 36, 43, and 31 substantially compartmentalize the gas.

Persons skilled in the art will realize that the composition of the reducing gas in reducing compartment 32 is somewhat different from that of reducing compartment 37. The reducing gas in reducing compartment 37, particularly heat strip exit 44, may be relatively pure, or at least have a high concentration, while that in reducing compartment 32 has a lower concentration, having already reduced a large portion of the mill scale on strip 30. Thus the strength of the reducing gas in reducing compartment 37 is substantially greater than that of reducing compartment 32. As the rate of the reducing reaction is greater with higher purity compared to lower concentration of active reducing gas, the compartmentalization illustrated by the use of reducing compartments 37 and 32 is utilized to maintain the concentration of hydrogen or other reducing gas at a higher level in compartment 37 than it would otherwise be throughout at equivalent length of strip 30 if the reducing zone were not compartmentalized. We prefer that, even near sealing rolls 47, where strip 30 enters reducing compartment 37, the concentration of hydrogen or other reducing gas be maintained at least at 2% in the gaseous atmosphere of reducing compartment 37, preferably at least 25%, and at least 2%, preferably at least 10%, in compartment 32. Generally, the gas entering exhaust trap 46 will contain at least 0.001% water vapor and, where hydrogen is used as the reducing gas, no more than 99% hydrogen. The balance of the gas entering exhaust trap 46 may include carbon monoxide, nitrogen, and methane. Passage 43, which contributes to the maintenance of the higher concentration of reducing gas in reducing compartment 37 than in compartment 32, may include a small diameter pipe connecting compartments 37 and 32.

Figure 5:
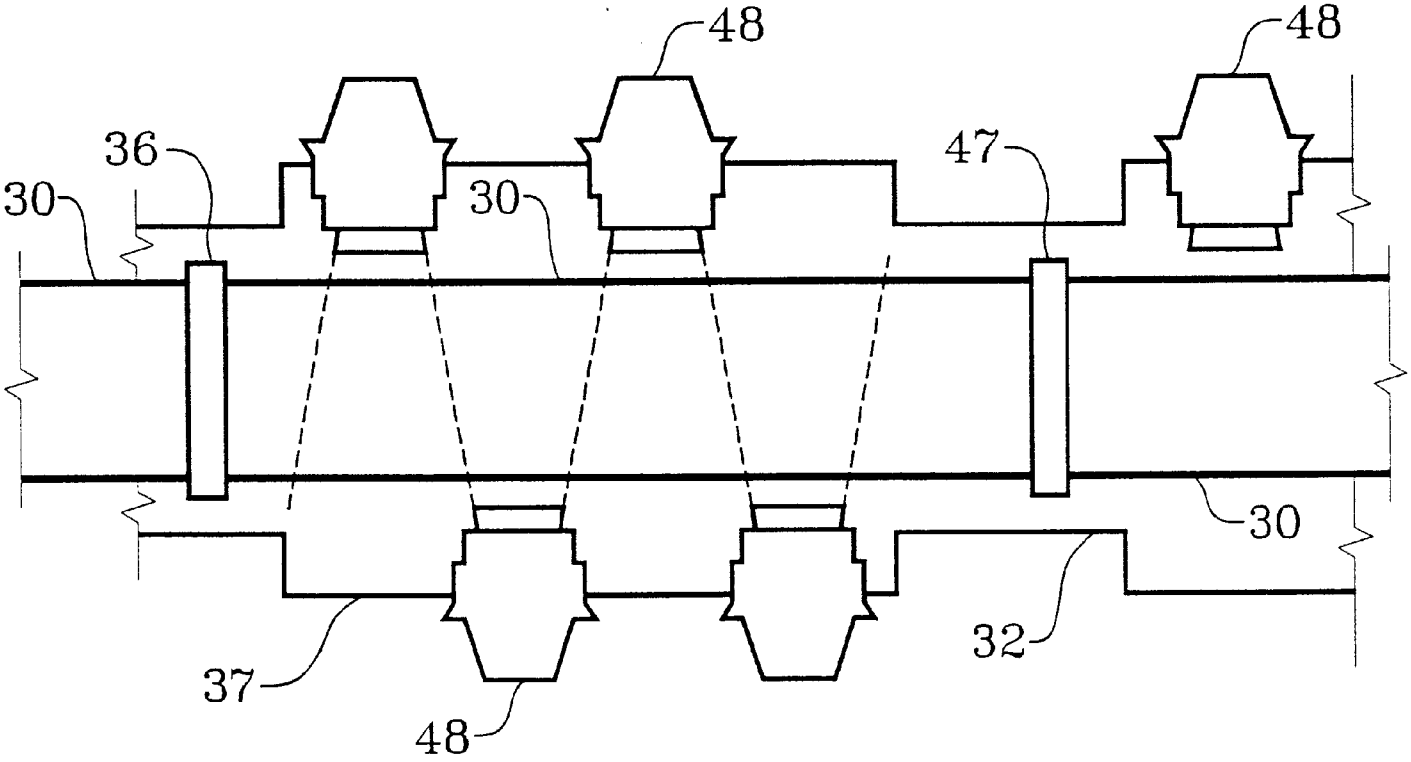
FIG. 5 is an overhead view of the reducing zone enclosure of FIG. 4.

Fans 48 are placed in both reducing compartments 32 and 37 to provide turbulence for assuring good contact of the reducing gas with the strip 30, and to mix the reducing atmosphere so there will be no pockets of very low active reducing gas concentration in the atmosphere contacting the strip 30. Intakes for fans 48 are within the reducing compartments 32 and 37. Fans 48 are placed to assure turbulence in the reducing atmosphere both above and below the strip 30. As seen in FIG. 5, an overhead view of a preferred configuration of reducing zone 36, the fans 48 are preferably placed so the strip 30 is exposed to alternating gas flow in alternate directions as it proceeds through the reducing compartment 37. A similar configuration of fans is in reducing compartment 32. The fans 48 are deployed also so they are not directly across from each other, and so they will provide a more or less continuous circulation of the gas while providing turbulent contact with the strip 30. Dotted lines 49 depict a preferred projection of the gas flow from fans 48, avoiding energy-consuming conflict with other fans 48. This separation of the gas flows may be assisted by baffles, not shown.

Figure 6:
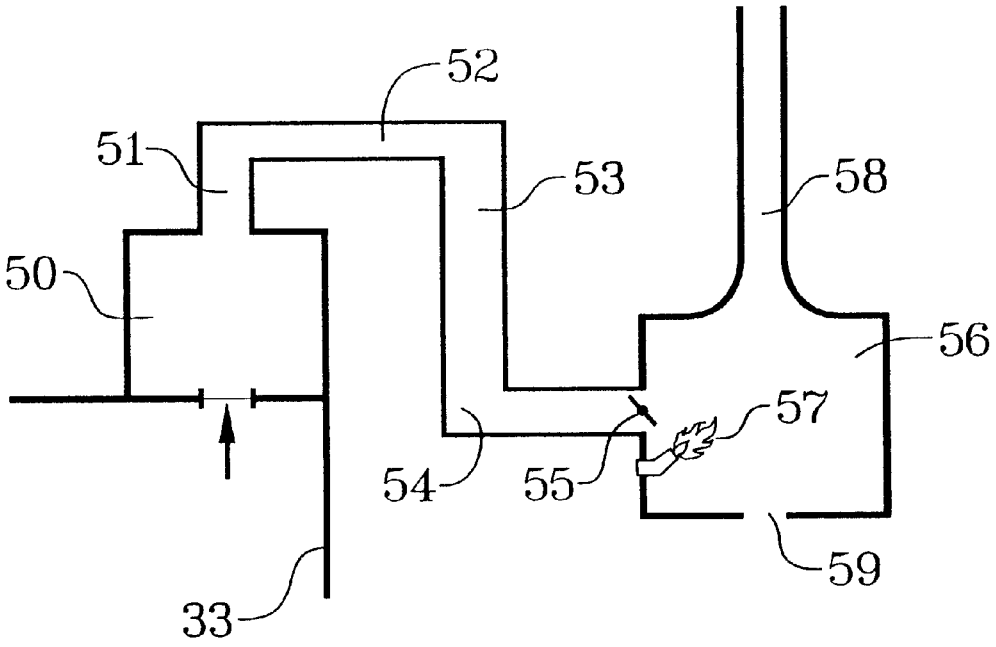
FIG. 6 is a side sectional view of a preferred exhaust trap for waste gases.

In FIG. 6, details of exhaust trap 46 (see FIG. 4) are shown. Exhaust trap 46 comprises a hood 50 having a gas exit 51. Gas exit 51 leads to a duct 52 of a higher elevation than hood 50, which, leads to a downcomer 53 terminating at an elbow 54 positioned lower than hood 50. Elbow 54 leads in turn to damper 55 and thence to chamber 56 which contains at least one constantly lit burner 57. Combustion in burner 57 may be assisted by air introduced through inlet 59. Chamber 56 has a flue 58 to atmosphere. In operation, used or substantially exhausted reducing gas from reducing compartment 32 is led by a negative pressure from flue 58, through gas exit 51, to hood 50. Pressure differences will cause the exhaust gas to descend into elbow, 54 from downcomer 53 and immediately into chamber 56 where it is burned at burner 57. The configuration of the duct 52 and downcomer 53 tends to stabilize the flow of gas. Dampers 55 may be adjusted either automatically as a function of flow, or manually as conditions may dictate. Damper 55 may also be used to shut off the flow of gas and/or to prevent the backflow of air into downcomer 53. Heat generated by burner 57 and/or the combustion of the used of substantially exhausted reducing gas may be conserved and used in any known manner to assist in the heating of strip 30, either in furnace 36 or elsewhere.

Thus our invention may utilize a single reducing compartment but includes a variation in which the reducing zone comprises at least two sealed reducing compartments in tandem. The reducing gas, preferably hydrogen, is passed turbulently and countercurrently to the moving steel strip containing mill scale, or other oxied-covered metal, at a first relatively high concentration in a first reducing compartment and at a second, lower, concentration in a second reducing compartment. An exit is provided for the exhaust reducing gas, wherein any remaining combustible component is combusted after passing through an inverted U shaped duct to minimize surges and the risk of explosion.

After emerging from sealing rolls 36, strip 30 is typically still covered by a sponge layer—that is, a thin layer substantially or iron (in the case of steel), the remains of the mill scale. The strip or other metal is then led to a cooling zone, not shown, where it may be cooled by any effective means to a temperature preferably no higher than 150° C., preferably within an inert or slightly reducing atmosphere during the cooling process, to minimize reoxidation after the process is finished. A preferred method of cooling is to spray or otherwise contact the surface of the strip or other metal with cooling water containing a corrosion inhibitor such as sodium nitrite. To preserve the neutral or slightly reducing atmosphere, the entrance and exit to the cooling zone should be sealed with fabric or any other effective sealing means. The cooling zone is preferably followed by scrubbing by a brush scrubber or other effective scrubber means for mechanically removing foreign matter and/or the reduced mill scale or sponge layer, and/or polishing or retexturing the surface. We intend to include high pressure sprays, as well as brushes, as means for cleaning, scribbing, or mechanically removing foreign matter.

What is claimed is:

1. Method of reducing oxides on the surface of metal comprising moving said metal through an enclosure having an entrance and an exit for said metal, heating at least the surface of said metal to a temperature of at least 300° F. in a heating zone near said entrance of said enclosure, introducing reducing gas to a cooling zone near said exit of said enclosure, directing said reducing gas toward said surface of said metal in a vigorous and turbulent manner in a reducing zone in said enclosure, whereby at least 5% of said reducing gas is consumed in reducing said oxides, and burning unreacted reducing gas below a flue near said entrance for said metal to create a draft of said reducing gas in said enclosure countercurrent to the movement of said metal.

2. Method of claim 1 including contacting at least one surface of said metal with elemental carbon.

3. Method of claim 1 wherein said exit for said metal includes a fabric curtain.

4. Method of claim 1 wherein inert gas is mixed with said reducing gas.

5. Method of claim 1 wherein inert gas is mixed with said reducing gas in a ratio of 1:99 to 99:1.

6. Method of claim 1 wherein at least a portion of said reducing gas is heated before being introduced in said reducing zone.

7. Method of claim 1 whereby said reducing gas is heated within said enclosure before being directed toward said metal.

8. Method of claim 1 wherein said reducing gas comprises hydrogen.

9. Method of claim 1 wherein said reducing gas comprises carbon monoxide.

10. Method of claim 1 wherein at least about 50% of said reducing gas is consumed in reducing said oxides.

11. Method of claim 1 wherein at least about 90% of said reducing gas is consumed in reducing said oxides.

12. Method of claim 1 wherein air is introduced near said entrance to said enclosure to assist in burning said unreacted reducing gas.

13. Method of claim 1 wherein said metal is steel strip.

14. Method of claim 1 wherein said metal is copper.

15. Method of reducing oxide scale on metal wherein said metal is contacted with reducing gas, said process comprising (a) heating said metal to at least 300° F., (b) contacting said metal with turbulent reducing gas in at least two successive reducing zones having increasing concentrations of reducing gas, to make (i) metal having a reduced surface and (ii) a used reducing gas, and (c) combusting said used reducing gas.

16. Method of claim 15 wherein said metal is hot rolled steel strip.

17. Method of claim 15 wherein said metal is copper.

18. Method of claim 15 wherein said reducing gas comprises hydrogen.

19. Method of claim 15 wherein said reducing gas is passed countercurrently through said at least two successive reducing zones.

20. Method of claim 19 which in continuous, including continuously removing said used reducing gas in a stabilized flow prior to combusting it.

21. Method of claim 19 further including cooling said metal having a reduced surface to a temperature no higher than 150° C.

22. Method of claim 21 wherein said cooling is accomplished by contacting said metal having a reduced surface with cooling water containing a corrosion inhibitor.

23. Method of claim 19 wherein said metal is copper and further including the steps of cooling said copper to a temperature no higher than 150° C.

24. Method of claim 23 further including brushing said copper.

25. Method of claim 19 wherein turbulence is induced in said reducing zones by a plurality of fans.

26. Method of claim 19 followed by cooling and scrubbing said metal having a reduced surface.

* * * * *

UNITED STATES PATENT AND TRADEMARK OFFICE

CERTIFICATE OF CORRECTION

PATENT NO. : 6,406,550 B1 
DATED : June 18, 2002
INVENTOR(S) : Stephen L. Feldbauer and Brian H. Braho It is certified that error appears in the above-identified patent and that said Letters Patent is hereby corrected as shown below:

Column 7,
Line 5, delete “36” and insert -- 34 --.

Column 8,
Line 38, delete “in” and insert -- is --.

Signed and Sealed this

Ninth Day of September, 2003

JAMES E. ROGAN
*Director of the United States Patent and Trademark Office*